US009834900B2

(12) United States Patent
Heinonen

(10) Patent No.: US 9,834,900 B2
(45) Date of Patent: Dec. 5, 2017

(54) PILING METHOD AND APPARATUS

(71) Applicant: Pentti Heinonen, Kuopio (FI)

(72) Inventor: Pentti Heinonen, Kuopio (FI)

( * ) Notice: Subject to any disclaimer, the term of this patent is extended or adjusted under 35 U.S.C. 154(b) by 0 days.

(21) Appl. No.: 15/175,099

(22) Filed: Jun. 7, 2016

(65) Prior Publication Data

US 2016/0289910 A1 Oct. 6, 2016

Related U.S. Application Data

(63) Continuation of application No. PCT/FI2014/050970, filed on Dec. 9, 2014.

(30) Foreign Application Priority Data

Dec. 10, 2013 (FI) ..... 20136240

(51) Int. Cl.
*E02D 7/10* (2006.01)
*E02D 7/02* (2006.01)
*E02D 7/14* (2006.01)

(52) U.S. Cl.
CPC ..... *E02D 7/10* (2013.01); *E02D 7/02* (2013.01); *E02D 7/14* (2013.01)

(58) Field of Classification Search
USPC .... 405/228, 232, 245; 173/1, 115, 206, 207, 173/208, 212
See application file for complete search history.

(56) References Cited

U.S. PATENT DOCUMENTS 3,205,790 A 9/1965 Bollar ..... 72/20
3,714,789 A * 2/1973 Chelminski ..... E02D 7/00 173/1
3,721,095 A 3/1973 Chelminski ..... 61/53.5
3,797,585 A 3/1974 Ludvigson ..... 173/131
3,869,003 A 3/1975 Yamada ..... 175/171
4,121,671 A 10/1978 West ..... 173/131
4,262,755 A 4/1981 Kuhn ..... 173/131
4,377,355 A * 3/1983 Chelminski ..... E02D 7/10 172/1
4,802,538 A 2/1989 Hays et al. ..... 173/1

FOREIGN PATENT DOCUMENTS

GB 2 035 866 A 6/1980
GB 2 161 731 A 1/1986
GB 2 318 755 A 5/1998

* cited by examiner

*Primary Examiner* — Sean Andrish
(74) *Attorney, Agent, or Firm* — Harrington & Smith

(57) ABSTRACT

A pile is moved downwards by a movable part inside a piling apparatus. An apparatus body is fastened to the pile by fastening elements, during piling the movable part inside the apparatus body is moved downwards, the movable part is stopped hydraulically by medium in a cylinder space without the movable part striking the apparatus body. As the downwards directed motion of the movable part is stopped, the apparatus body and the pile fastened to it jerk downwards, after which, the movable part is moved hydraulically upwards. The counterforce of the motion affects the apparatus body and the pile fastened to it by pushing them downwards. The piling apparatus includes hydraulic cylinder cylinder to the piston of which the movable part is fastened, and to the hydraulic cylinder are connected a pressure transformer, a damping apparatus and a set of control valves to stop the movable part hydraulically.

5 Claims, 6 Drawing Sheets

PILING METHOD AND APPARATUS

The application is a continuation of International Patent Application No. PCT/FI2014/050970 filed on Dec. 9, 2014.

BACKGROUND OF THE INVENTION

This invention relates to a piling method in which a pile or an equivalent being below an apparatus is moved mainly downwards by means of a movable part inside the apparatus. Furthermore, the invention relates to a piling apparatus which includes a body and a part movable inside the body.

Piling methods and apparatuses are utilised in embedding piles, columns or equivalents which are used e.g. to reinforce building foundations or to reinforce, support or compact ground.

Known apparatuses commonly include a part movable in the vertical direction i.e. upwards and downwards i.e. a hammer ram and a separate cushion block to be located on top of the pile. When driving the pile, the movable part i.e. hammer ram is above the pile, the movable part i.e. hammer ram is moved in the vertical direction and it is hit onto the freely moving cushion block located at the upper end of the pile. Then, the pile is pushed downwards. The cushion block decreases the stress applied to the pile. Often, there is between the pile and the cushion block other material which dampens and softens the hit. This causes the weakening of piling efficiency and the breaking of the pile and the cushion block.

Disadvantages are related to the use of known apparatuses. When the hammer ram hits the cushion block and the cushion block hits the pile, a powerful hitting noise is created. Piling is very noisy work, which must be considered when designing working sites and working hours. When using cushion blocks and other damping materials, part of work efficiency is lost when the hit of the hammer ram is dampened when striking the cushion block. Furthermore, cushion blocks and other damping materials are parts which wear and which have to be replaced from time to time, whereby work must be interrupted. A problem of the use of cushion blocks and other softening materials is also that their properties change as they wear, whereby the exact monitoring of the hit event is difficult.

The properties and quality of the ground to be piled vary considerably due to different soils. This is worth considering when driving piles.

When handling steel piles and sheet piles, the work often requires pulling them upwards in some stage. Pulling sheet piles up is recently done by vibrating, which sets off the disturbance of the soil in the working area, which further makes working awkward. There also occur problems when pulling the protection pipes of cast-in-place piles up. After the cast-in-place pile has been cast inside the protection pipe hit into the ground, the protection pipe is pulled off. There exists no suitable method for this. When a vibrator is used in pulling up, the surrounding ground is disturbed and the carrying capacity of the pile is weakened as the ground properties change.

An object of the invention is to disclose a piling method and apparatus which eliminate disadvantages related to recent piling methods and apparatuses. A particular object of the invention is to introduce a piling method and apparatus which provide effective, cost-efficient and noiseless piling. A further object of the invention is to disclose a piling method and apparatus which provide a jerky motion.

DESCRIPTION OF THE INVENTION

In a method according to the invention, an apparatus body is fastened to a pile or an equivalent by fastening elements, during piling a movable part inside the apparatus body is moved downwards, the movable part is stopped hydraulically by means of medium in a cylinder space without the movable part striking the apparatus body or some other part whereby, as the downwards directed motion of the movable part stops, the apparatus body and the pile or equivalent fastened to it jerk downwards, after which, the movable part is moved hydraulically upwards, whereby a counterforce of the motion affects the apparatus body and the pile or equivalent fastened to it by pressing them downwards. When the movable part starts to move downwards, a counterforce of the force required to the transfer tries to swing the apparatus body and also the pile fastened to it upwards. By means of the swing, the pile or equivalent fastened to the apparatus swings suitably, whereby friction between the pile and the ground decreases, which facilitates the downwards pressing power of the immediately coming downwards directed jerk. The force applied to the pile can be adjusted in a desired way by adjusting the speed and damping of the hit. The speed of the movable part is freely adjustable upwards and downwards and, for this reason, it is possible to choose a suitable jerking frequency for the pile or equivalent.

By means of stopping the downwards directed motion of the movable part, it is possible to make the apparatus body to jerk downwards. When the pile or equivalent being below the apparatus is fastened securely to the apparatus body, the downwards pressing force transfers directly via the apparatus body to press the pile or equivalent downwards. In other words, stopping the movable part makes the pile or equivalent below to move via the apparatus body i.e. jerks it. Then, the pile is pushed downwards by means of the jerky motion of the body. The jerking effect of the apparatus on the pile or equivalent below is dependent on the weight of the movable part, the speed of the motion and the speed of the stopping. In the apparatus, the movable part will not strike any body part or other part, but the movable part is stopped in a desired location before the bottom part of the body.

When the movable part is lifted upwards, a counterforce of the motion affects the body and continuously presses the pile being below via the body and the duration of the totally downwards affecting force continues. This is a factor continuing the power of the above-described jerk.

In an advantageous embodiment of the invention, the speed of the downwards and upwards directed motion of the movable part and the duration of the stops are adjusted hydraulically. Thus, it is possible to effectively adjust the jerking frequency of the apparatus and the jerking force considering the ground properties and other possible factors.

When the apparatus body is fastened to a pile or an equivalent, the apparatus is always parallel with the pile or equivalent, whereby piling or other work is efficient. There is no need to correct the position of the apparatus in relation to the pile or another working device when driving piles.

To the apparatus body are fastened sensors which describe the motion and the position of the pile or equivalent and the power provided by each jerk. Current, accurate and reliable information is then obtained all the time and continuously of the piling event which information can be immediately considered and, based on which, piling can be adjusted.

In an apparatus according to the invention, the body includes fastening elements for fastening the body to the pile, the movable part is a hammer ram, the apparatus includes a hydraulic cylinder to the piston of which the hammer ram is fastened, and to the hydraulic cylinder are integrally connected a pressure transformer and damping apparatus and a set of control valves to stop the movable part hydraulically without the movable part striking the apparatus body or some other part.

The piling method and apparatus according to the invention are in many ways different from known methods and apparatuses. Differences with previous methods/apparatuses are not hitting the end of the pile or equivalent and not using a cushion block normally included in piling apparatuses. A further advantage and difference is that the reciprocating motion i.e. jerking of the movable part and the motion speed of the movable part both upwards and downwards and the speed of the direction change of the movable part can be adjusted in a desired way and, thus, it is possible to adjust as desired the magnitude of the force applied to the pile or equivalent, pressing it downwards. Then, the ground properties and quality can be considered and the frequency and power of the motions of the movable part can be chosen as to facilitate penetrating the ground and restoring the condition of the pile and, on the other hand, maximum efficiency on the whole can be achieved. An advantage is also that the method and the use of the apparatus are noiseless: instead of hits, only little noise caused by hydraulic valves is heard from the apparatus. Furthermore, the piling method and apparatus according to the invention are also suitable for lifting up piles or equivalents, e.g. protection pipes, when the kinetic energy provided by its jerks is directed opposite to that of pressing to the ground. Then when jerking upwards, the apparatus body and the protection pipe fastened to it decrease friction and, when simultaneously the protection pipe is pulled upwards, the pulling up becomes easier and the ground properties do not change.

It is possible to fasten to the apparatus body in a way known as such a sensor apparatus, by means of which, the piling is monitored all the time When the apparatus body is fastened to the pile and the sensors are fastened to the body, the sensors fastened to the body can monitor the driving of the pile reliably.

DESCRIPTION OF THE DRAWINGS

The invention will now be described in more detail with reference to the accompanying drawings in which

FIG. 1 shows as an illustration of principle a piling apparatus according to the invention and parts pertaining to it. The piling apparatus includes a body 1, which body includes inside of it a movable part 2 i.e. hammer ram visible in its top part and a hydraulic cylinder 3 fastened to it. The bottom part of the body includes fastening elements 4 by means of which the apparatus is fastenable to a pile or an equivalent (not shown in the figures) being below it. The fastening elements are fastening elements known as such which are hydraulically-operating elements. The top part of the body includes a fastening lug for fastening the body to some apparatus.

FIGS. 2-6 shows a hydraulic device required for moving a movable part i.e. hammer ram (not shown in these figures) being inside a body (not shown in these figures) and parts and elements related to it. The device includes a double-acting hydraulic cylinder 3 which is integrally connected to a pressure transformer and damping apparatus and a set of control valves. The hydraulic device in question i.e. the hydraulic cylinder 3 is connected between the apparatus body and the movable part i.e. hammer rain. The hydraulic cylinder is provided with duct fittings 13, 14 and 15, by means of which, pressure medium is conveyed to the cylinder and pressure medium is extracted from there in the various stages of the operation. The duct fitting 13 is at the upper end of the body, the duct fitting 14 is in the middle section of the body below the centre and the duct fitting 15 is in the bottom part of the body.

Figure 1:
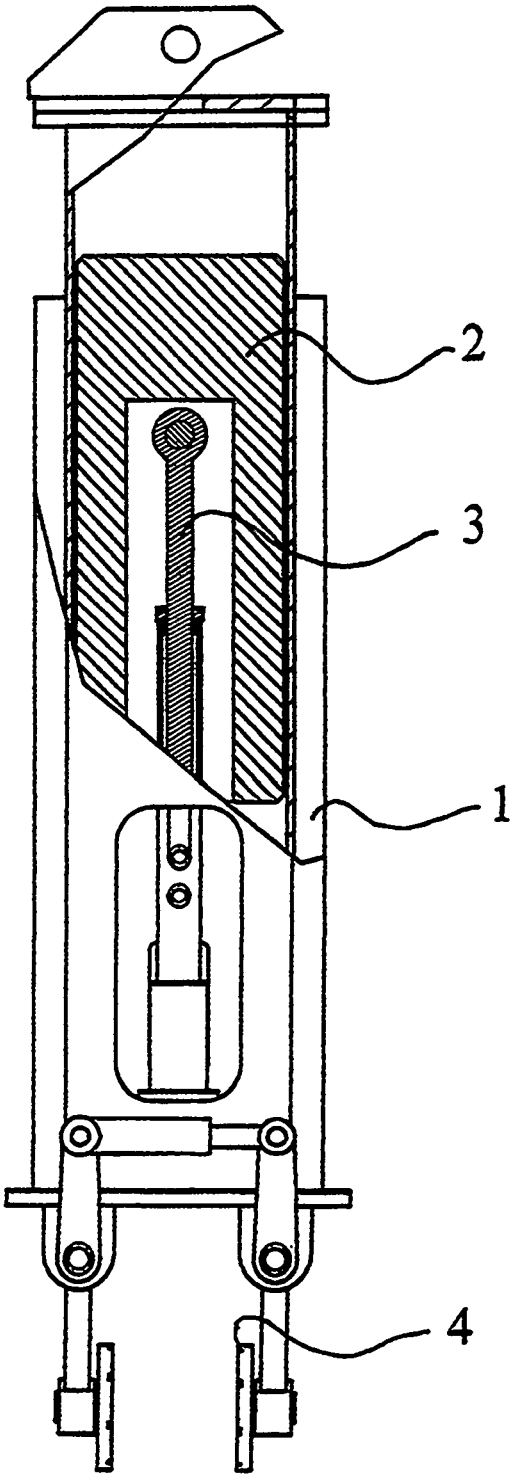
FIG. 1 shows a partially cut side view of a piling apparatus according to the invention and FIGS. 2-6 show side views of the inner structure of an apparatus according to the invention which includes a hydraulic cylinder and parts related to it as illustrations of principle and their cross sections in the various stages of the operation of the apparatus.

The pressure transformer apparatus includes a pressure transformer 20 inside the hydraulic cylinder, movable in relation to it and a pressure accumulator 18 which is connected by a duct 17 to a cylinder space 21 below the pressure transformer 20. Above the pressure transformer, there is an upper cylinder space 22.

A bottom part 7 of a piston 6 of the hydraulic cylinder 3 is shaped such that it forms an edge controlling the flow of medium. The controlling edge of the bottom part 7, the piston skirt, is used to close the duct fitting 14 partially or totally. The piston skirt can also push the piston of the pressure transformer 20 ahead of it.

The set of control valves include valves 9-12 which control the direction and force of the motion of the hydraulic cylinder. The valves 9 and 11 are connected to a pressure source and the valve 10 is connected to the valve 9. The valve 9 is connected to the duct 13. A pressure accumulator 16 is between the valve 9 and the duct 13. The valve 10 is connected to the duct fitting 14. A return valve 12 is connected to the duct fittings 14 and 15.

Next; the operation of the apparatus according to FIGS. 1-6 is described with reference to FIGS. 2-6.

Figure 2:
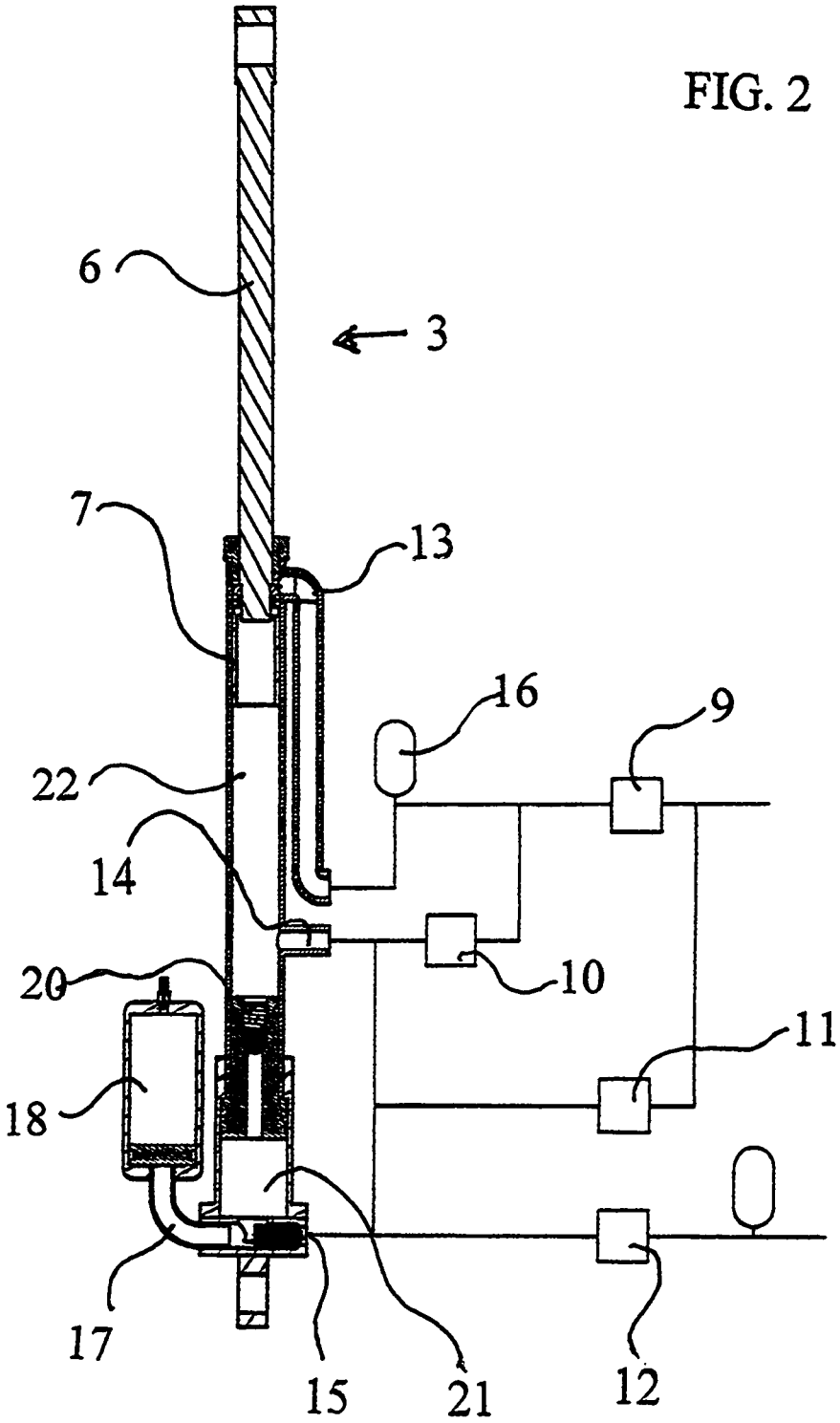

FIG. 2 shows a starting point from which the hammer ram is accelerated downwards and, simultaneously, the cylinder piston fastened to it is moved downwards. Then, the valves 9 and 12 are open and the valves 10 and 11 are closed.

Figure 3:
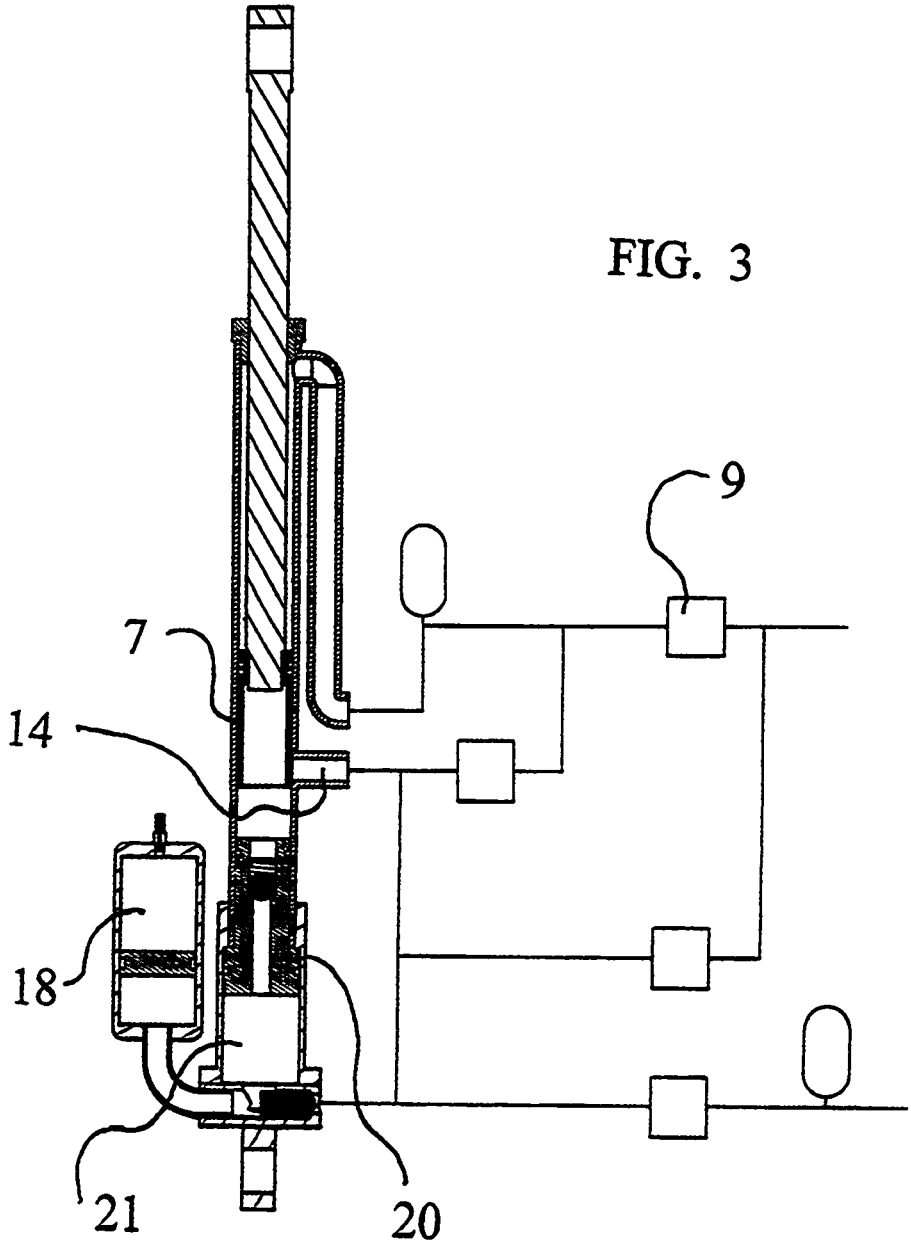

In FIG. 3, the piston skirt closes the duct fitting 14 and the pressure medium in the upper cylinder space or the piston skirt pushes the piston of the pressure transformer 20 downwards, whereby the medium from the cylinder space 21 below the pressure transformer transfers to the pressure accumulator (or damping apparatus) 18. Simultaneously, the valve 9 is closed and the valve 10 is opened. Then, the motion of the hammer ram and the piston is braked, and the pressure of the medium is stored to the pressure accumulator 18. After the hammer ram and the piston have stopped, the motion direction changes and the pressure accumulator discharges its energy to lift the hammer ram. This stopping causes a jerk which is conveyed via the apparatus body to the pile or equivalent.

Figure 4:
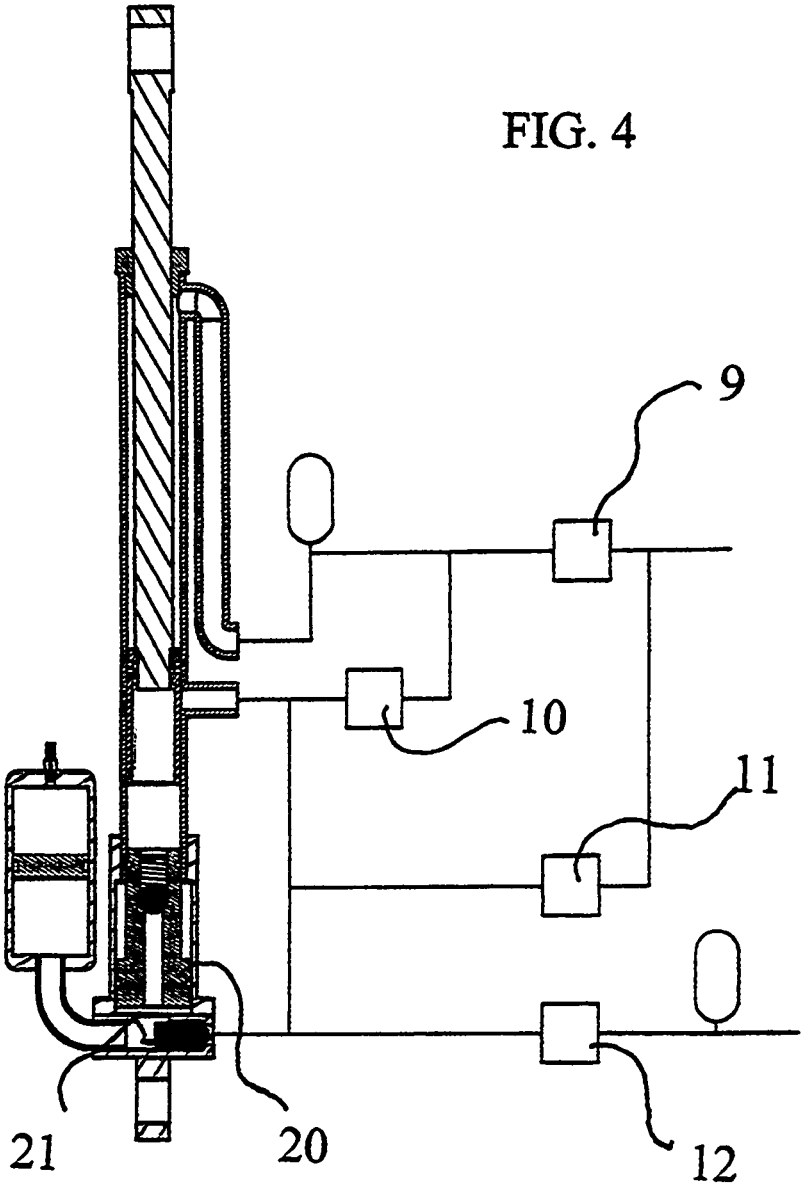

In FIG. 4, the motion has stopped and the medium transfers from the pressure accumulator to the lower cylinder space 21, whereby the piston of the pressure transformer 20 starts to go upwards. In this stage, the valves 9 and 11 are closed and the valves 10 and 12 are open.

Figure 5:
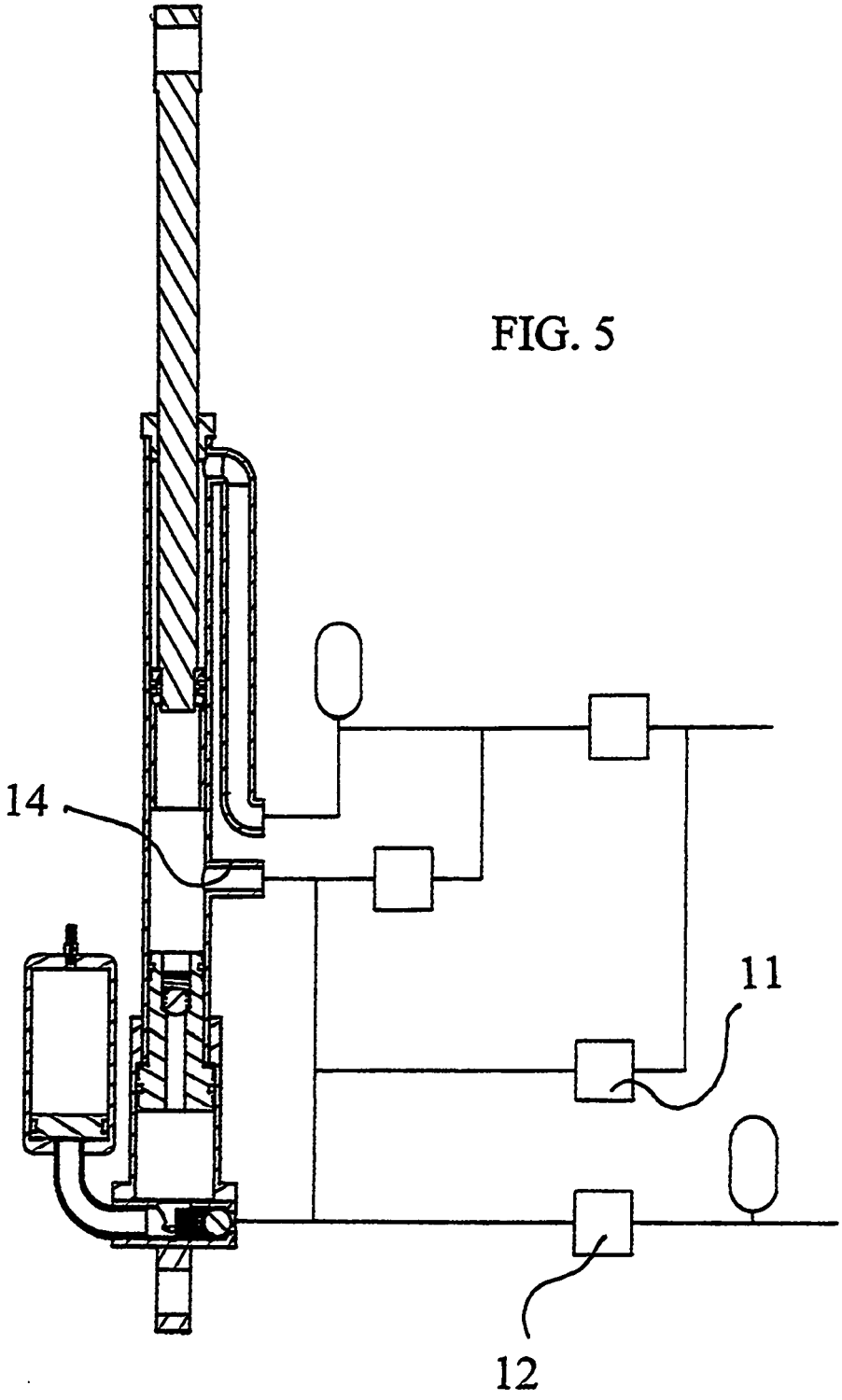
Figure 6:
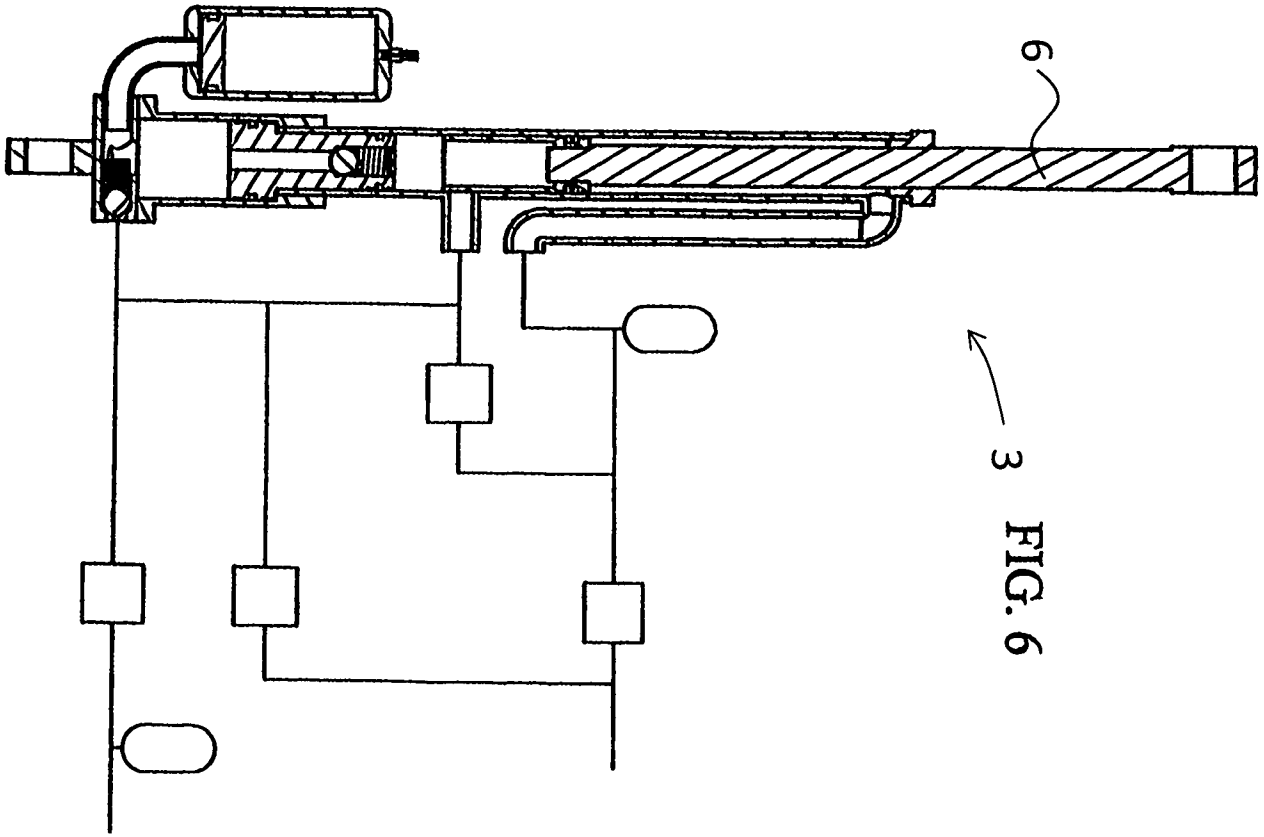

In FIG. 5, the piston skirt has reached the duct fitting 14, whereby the valve 11 is opened and the valve 12 is closed. Now, the pressure medium lifts the cylinder piston to a desired height from which a new work cycle starts according to FIG. 6.

The apparatus can also make a short oscillating motion if no high-power motion is required. When the valve 11 is opened and the valves 9,10 and 12 are closed, the cylinder piston lifts the hammer ram to a desired height, whereby the pressure medium above the piston has been charged to the pressure accumulator 16. Then, the valve 11 is closed and the valve 12 is opened. In that case, the hammers ram starts to move downwards and it is braked by the pressure transformer which charges the pressure accumulator 18. As the direction of the hammer ram changes, the valve 11 is opened and the valve 12 is closed.

When using the apparatus, the apparatus body 1 is fastened to a crane, the framework of a piling apparatus or some other device or apparatus with suitable fastening elements known as such. It can also be fastened to other constructions in a desired way depending on the purpose and use. Using the apparatus provides a jerky motion applied to a pile or an equivalent, directed upwards and downwards, the power and direction of which motion can be adjusted in a desired way.

The medium is a liquid medium suitable for the purpose.

The invention is not limited to the described advantageous embodiments, but it can vary within the scope of the inventive idea presented in the claims.

The invention claimed is:

1. A piling method comprising:

moving a pile or an equivalent located below an apparatus mainly downwards by means of a movable part inside the apparatus, fastening an apparatus body to the pile or equivalent by fastening elements, wherein the movable part is fastened to a piston of a hydraulic cylinder, wherein a pressure transformer, a damping apparatus and a set of control valves are integrally connected to the hydraulic cylinder, wherein the pressure transformer is between a first cylinder space and a second cylinder space, wherein during piling, moving the movable part inside the apparatus body downwards, stopping the movable part hydraulically by means of a medium in the first and second cylinder spaces of the hydraulic cylinder without the movable part striking the apparatus body or some other part, whereby, as the downwards directed motion of the movable part is stopped, the apparatus body and the pile or equivalent fastened to the apparatus body jerk downwards, after which, moving the movable part hydraulically upwards, whereby a counterforce of the motion affects the apparatus body and the pile or equivalent fastened to the apparatus body by pushing the apparatus body and the pile or equivalent fastened to the apparatus body downwards, wherein the first cylinder space is between the piston and the pressure transformer, and wherein the second cylinder space is in fluid communication with the damping apparatus.

2. The piling method according to claim 1, further comprising:

adjusting the speed of the downwards and upwards directed motion of the movable part and a duration of the stops hydraulically.

3. The piling method according to claim 1, further comprising:

conveying part of the medium in the cylinder space below the movable part out of the cylinder space during a downwards directed motion of the movable part.

4. The piling method according to claim 1, further comprising:

conveying pressurised medium to the cylinder space below the movable part during an upwards directed motion of the movable part.

5. A piling apparatus comprising:

a body and a movable part inside the body, wherein the body includes fastening elements for fastening the body to a pile, and wherein the movable part is a hammer ram, a hydraulic cylinder comprising a piston, wherein the movable part is fastened to the piston, and a pressure transformer, damping apparatus, and a set of control valves connected to the hydraulic cylinder and configured to stop the movable part hydraulically without the movable part striking the apparatus body or some other part, wherein the pressure transformer is between a first cylinder space and a second cylinder space, wherein the first cylinder space is between the piston and the pressure transformer, and wherein the second cylinder space is in fluid communication with the damping apparatus.

* * * * *